US011270545B2

(12) United States Patent
Chang et al.

(10) Patent No.: US 11,270,545 B2
(45) Date of Patent: Mar. 8, 2022

(54) COIN DISPENSER

(71) Applicant: INTERNATIONAL CURRENCY TECHNOLOGIES CORPORATION, Taipei (TW)

(72) Inventors: Chia-Min Chang, Taipei (TW); Hung-Yi Chang, Taipei (TW); Dong-Ying Yang, Taipei (TW)

(73) Assignee: INTERNATIONAL CURRENCY TECHNOLOGIES CORPORATION, Taipei (TW)

( * ) Notice: Subject to any disclaimer, the term of this patent is extended or adjusted under 35 U.S.C. 154(b) by 168 days.

(21) Appl. No.: 16/717,908

(22) Filed: Dec. 17, 2019

(65) Prior Publication Data

US 2021/0183195 A1 Jun. 17, 2021

(51) Int. Cl.

| | |
|---|---|
| ***G07D 1/02*** | (2006.01) |
| ***G07F 1/00*** | (2006.01) |
| *G07F 1/02* | (2006.01) |
| *G07F 1/04* | (2006.01) |

(52) U.S. Cl.

CPC ..... *G07D 1/02* (2013.01); *G07F 1/00* (2013.01); *G07D 2201/00* (2013.01); *G07F 1/02* (2013.01); *G07F 1/04* (2013.01)

(58) Field of Classification Search

CPC ..... G07D 1/02

See application file for complete search history.

(56) References Cited

U.S. PATENT DOCUMENTS

| | | | | |
|---|---|---|---|---|
| 5,295,900 | A * | 3/1994 | Tsuchida | G07D 9/008 453/57 |
| 8,210,336 | B2 * | 7/2012 | Nishida | G07D 1/00 194/302 |
| 10,347,067 | B2 * | 7/2019 | Onishi | G07D 3/14 |
| 2002/0061724 | A1 * | 5/2002 | Nomura | G07D 9/008 453/6 |
| 2002/0072319 | A1 * | 6/2002 | Abe | G07D 9/008 453/49 |
| 2003/0148729 | A1 * | 8/2003 | Abe | G07D 9/008 453/57 |
| 2003/0201146 | A1 * | 10/2003 | Abe | G07D 1/02 194/302 |
| 2006/0019591 | A1 * | 1/2006 | Abe | G07D 3/14 453/18 |
| 2007/0212997 | A1 * | 9/2007 | Kurosawa | G07D 9/008 453/49 |
| 2010/0029188 | A1 * | 2/2010 | Komoto | G07D 1/02 453/29 |
| 2012/0295528 | A1 * | 11/2012 | Itou | G07D 9/008 453/57 |
| 2021/0090370 | A1 * | 3/2021 | Blythin | G07F 5/24 |

* cited by examiner

*Primary Examiner* — Thien M Le
*Assistant Examiner* — Asifa Habib
(74) *Attorney, Agent, or Firm* — Muncy, Geissler, Olds & Lowe, P.C.

(57) ABSTRACT

A coin dispenser is disclosed to use a dialing rod of a dialing device of a coin dispensing unit to push one side of the peripheral edge of one metal coin so that the other side of the peripheral edge of the metal coin will push two coin-stopping columns of one spring plate of the coin dispensing unit, causing the two coin-stopping columns to slide along the peripheral edge of the metal coin, and thus, when the metal coin crosses two coin-stopping columns, the metal coin is sent out of the coin outlet, achieving the effect of dispensing one metal coin at one time.

8 Claims, 7 Drawing Sheets

COIN DISPENSER

BACKGROUND OF THE INVENTION

1. Field of the Invention

The present invention relates to coin dispensers and more particularly, such a coin dispenser, which uses a dialing rod of a dialing device of the coin dispensing unit to push one side of the peripheral edge of one metal coin so that the other side of the peripheral edge of the metal coin will push two coin-stopping columns of one spring plate of the coin dispensing unit, causing the two coin-stopping columns to slide along the peripheral edge of the metal coin, and thus, when the metal coin crosses two coin-stopping columns, the metal coin is sent out of the coin outlet, achieving the effect of dispensing one metal coin at one time.

2. Description of the Related Art

Today's fast development of social civilization and science and technology not only accelerates the pace of people's lives, but also makes the quality of life more convenient. Therefore, in order to consider the convenience and timeliness that the people pay attention to, many public places are equipped with automated vending machines, such as vending machines, ticket machines or coin exchange machines, to greatly saving personnel and employment costs. As more types of goods are sold, more additional functions are required.

Furthermore, in general, automated vending machines and game consoles on the market use coin acceptors to provide users with coins to operate, in order to achieve the purpose of unmanned operation and self-checkout. However, with the increase in the types of goods that can be traded and sold by automated vending machines, the unit prices are not the same, or according to the coin receiving function of the gaming machine, the coin acceptor inside the machine will be provided with an identification module to identify the authenticity and value of the inserted coins. Either country-made coins or playground-made tokens, they have different values and sizes. The coin acceptor must use a coin hopper to divert coins of different values to the corresponding coin collecting tubes for storage after coin value and authenticity identification, and use a coin dispensing unit for exchange, change, or refund with respect to the coins inserted by the user for transaction.

However, during the process that the coin dispensing unit pushes coins out for exchange, change or return, due to friction between two coins, two coins may be pushed out together, resulting in an exchanging error to cause loss of property.

Therefore, how to solve the above-mentioned shortcomings and inconveniences is the direction that related industry players are eager to study and improve.

SUMMARY OF THE INVENTION

The present invention has been accomplished under the circumstances in view. It is therefore the main object of the present invention to provide a coin dispenser, which comprises a body, at least one coin collecting tube and a coin dispensing unit. The body comprises a housing that defines therein an accommodation chamber. The at least one coin collecting tube is mounted in the housing, each defining therein a duct for receiving at least one metal coin. The coin dispensing unit comprises a casing mounted in the bottom side of the accommodation chamber inside the body below the at least one coin collecting tube, a storage space defined in the casing, at least one through hole cut through the top wall of the casing and aimed at the bottom end of the duct of one respective coin collecting tube, a coin outlet located on an opposing bottom wall of the casing, a drive module mounted in the storage space inside the casing, at least one dialing device disposed inside the storage space and located around the drive module and a spring plate mounted in each through hole of the casing. The dialing device comprises a shaft positioned on the bottom surface of the storage space, a paddle pivotally disposed on the shaft, a driving member located on one end of the paddle and drivable by the drive module to cause the paddle to rotate axially, and a dialing rod upwardly extended from an opposite end of the paddle. The spring plate comprises a positioning portion positioned on the peripheral wall of the associating through hole, two spring arms extended from one side of the positioning portion toward the inside of the associating through hole, a gap formed between the two spring arms for the insertion of the dialing rod, a channel formed on one side of the gap for the dialing rod to pass, and a coin-stopping column upwardly extended from the top surface of the distal end of each spring arm. When the dialing rod is pushed against one side of the peripheral edge of a metal coin, the other side of the peripheral edge of the metal coin pushes against the coin-stopping columns to slide along the peripheral edge of the metal coin so that when the metal coin crosses two coin-stopping columns, the metal coin is sent out of the coin outlet of the casing, achieving the effect of dispensing one metal coin at one time.

According to another aspect of the present invention, the height of the dialing rod exposed above the two spring arms of one spring plate is less than the thickness of one metal coin. Therefore, when the dialing rod pushes the peripheral edge of one metal coin, only one metal coin will be pushed out, and a second metal coin will not be pushed out to achieve the purpose of improving the reliability and stability of coin dispensing.

According to still another aspect of the present invention, the vertical distance between the surface of the stopper plate and the paddle is larger than the thickness of one metal coin but less than the combined thickness of two metal coins. Therefore, when the dialing rod pushes the peripheral edge of one metal coin, only one metal coin will be pushed out, and the second metal coin will be stopped by the stopper plate, thereby ensuring that the second metal coin will not be pushed out to achieve the reliability and stability of coin dispensing.

According to still another aspect of the present invention, the two coin-stopping columns of the dialing device are forced to slide along the peripheral edge of the metal coin to have the effect of limiting the position of the metal coin, so that the metal coin can be accurately pushed out. Therefore, the invention can be used with multiple metal coins of different sizes to achieve the purpose of improving the use stability and reducing the manufacturing cost.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
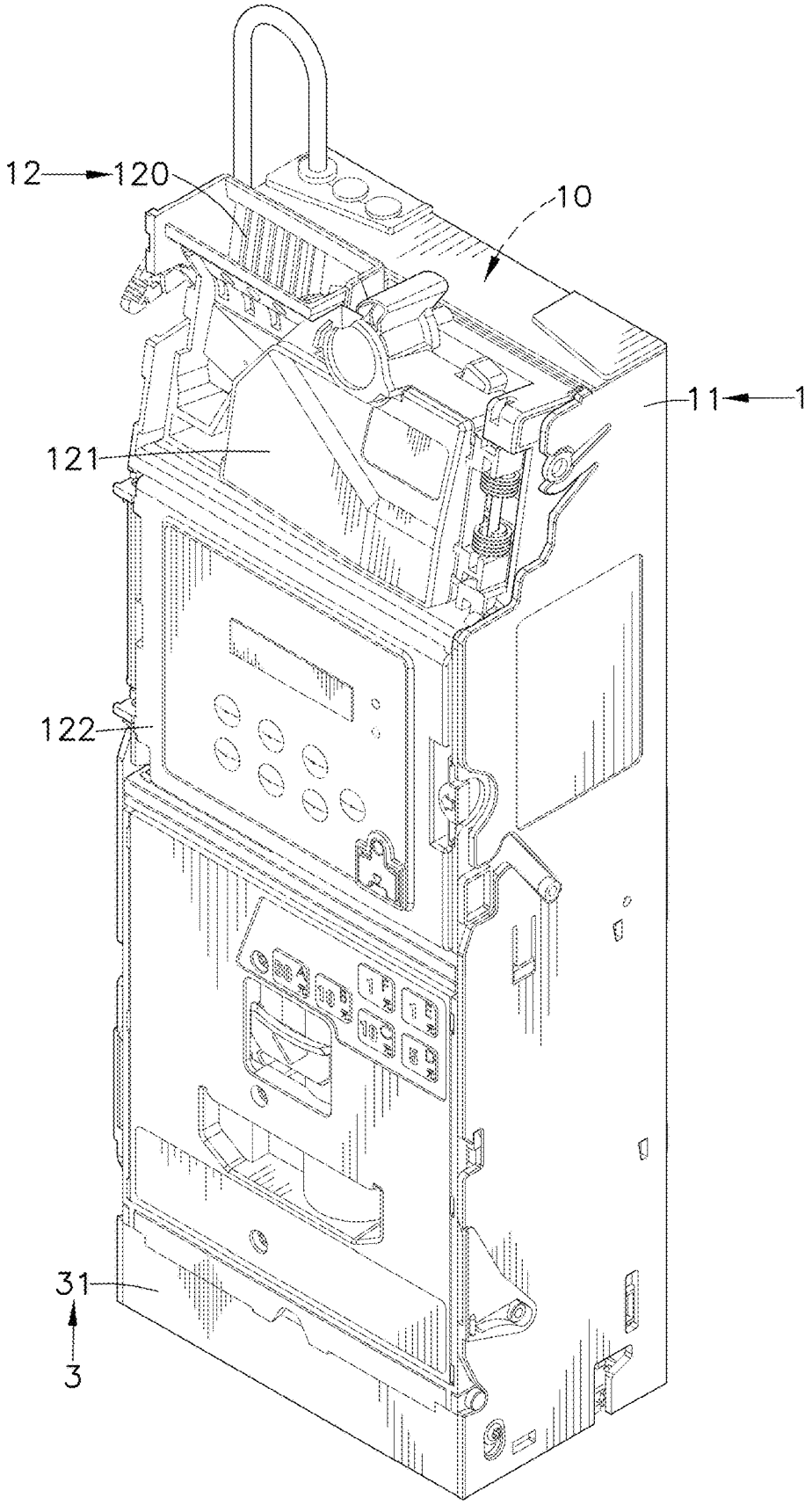
FIG. 1 is an oblique top elevational view of a coin dispenser in accordance with the present invention.
Figure 2:
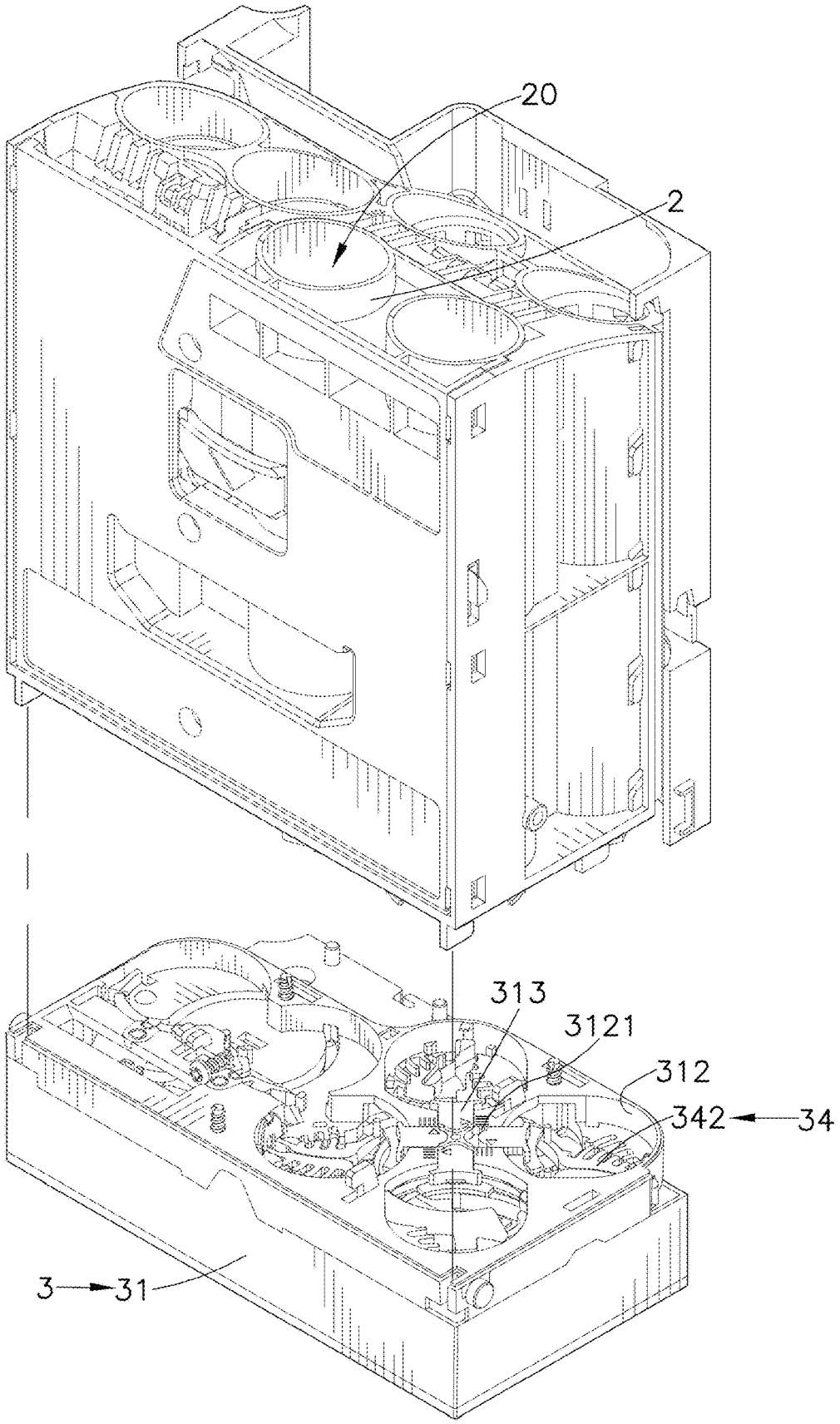
FIG. 2 is an elevational exploded view of a part of the present invention, showing the relationship between the coin collecting tubes and the coin dispensing unit.
Figure 3:
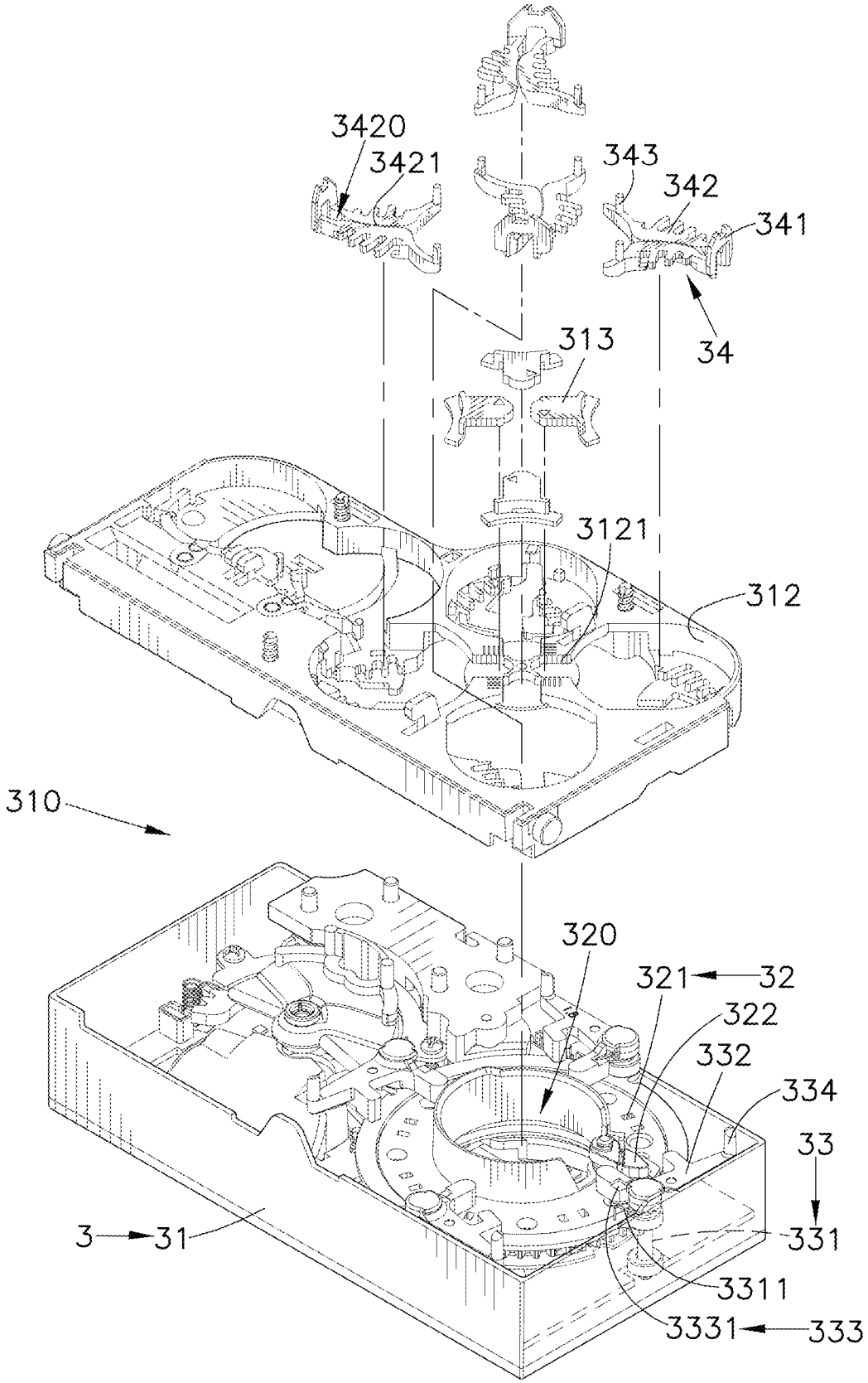
FIG. 3 is an exploded view of the coin dispensing unit.
Figure 4:
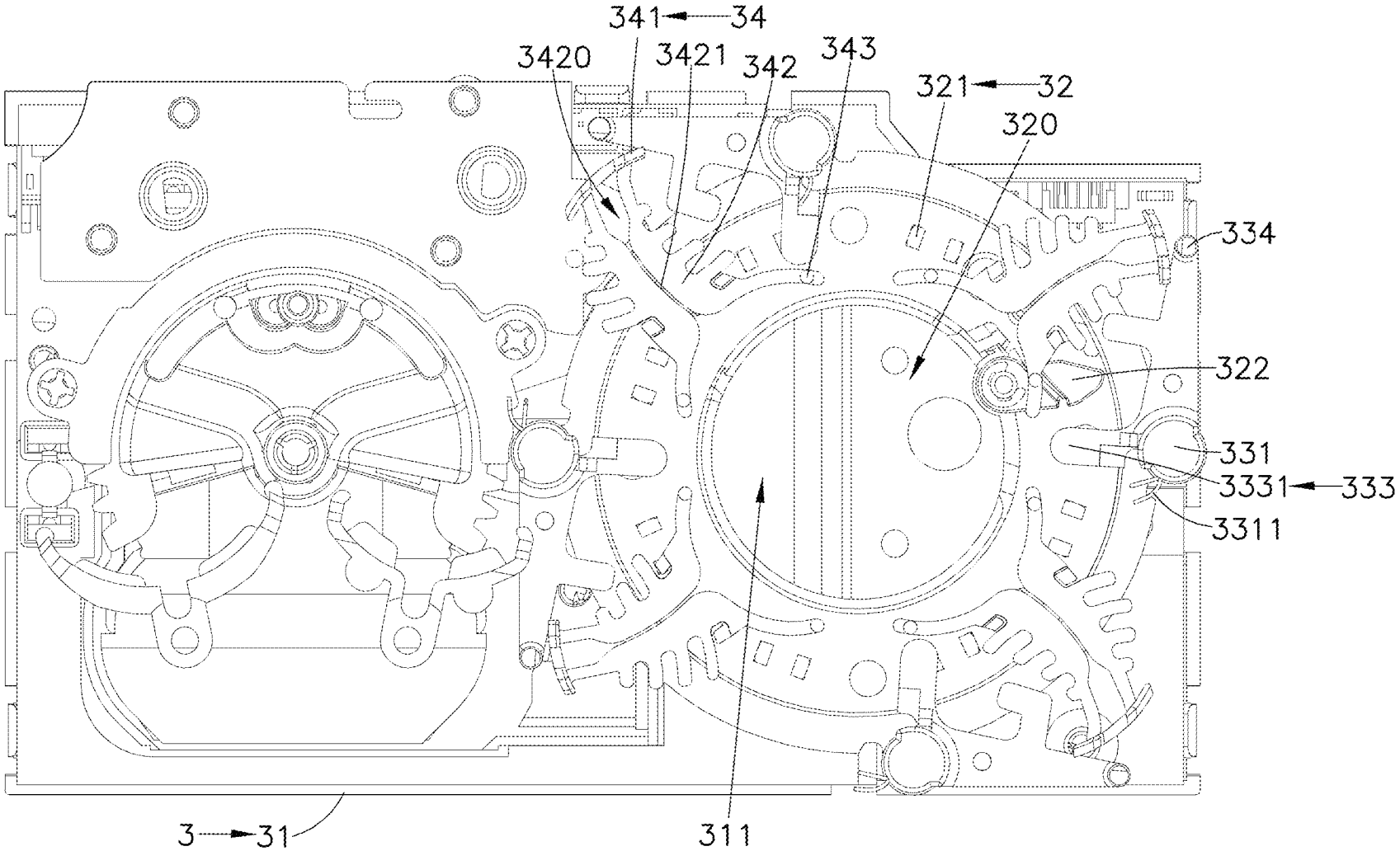
FIG. 4 is a top view of the coin dispensing unit.

Referring to FIGS. 1-4, a coin dispenser in accordance with the present invention is shown. As illustrated, the coin dispenser comprises a body 1, at least one, for example, a plurality of coin collecting tubes 2, and a coin dispensing unit 3.

The body 1 comprises a housing 11 defining therein an accommodation chamber 10, a coin hopper 12 disposed above the accommodation chamber 10 with a coin-inlet 120 defined at a top side thereof for the insertion of metal coins 4, an identification module 121 mounted in the coin hopper 12 below the coin-inlet 120 for identifying the authenticity and value of each inserted metal coin 4, and a coin sorting module 122 mounted in the coin hopper 12 below the coin-inlet 120 for sorting metal coins 4 identified by the identification module 121 into corresponding coin collecting tubes 2.

The coin collecting tubes 2 are in a cylindrical shape and assembled in the housing 11, and a duct 20 is formed in the hollow interior of each coin collecting tube 2 for receiving metal coins 4.

The ducts 20 of the coin collecting tubes 2 are different so that each coin collecting tube 2 can receive metal coins 4 of one respective value.

The coin dispensing unit 3 comprises a casing 31 assembled to the body 1 and located in the accommodation chamber 10 below the coin collecting tubes 2, a storage space 310 defined in the casing 31, a plurality of through holes 312 cut through a top wall of the casing 31 and respectively aimed at the bottom ends of the ducts 20 of the coin collecting tube 2, a coin outlet 311 located on an opposing bottom wall of the casing 31, a slot 3121 cut through the top wall of the casing 31 and radially extended from each through hole 312, a stopper plate 313 mounted in each slot 3121 and extended into the inside of the associating through hole 312, a drive module 32 mounted in the storage space 310 inside the casing 31 and comprising a turntable 321 for axial rotation, the turntable 321 being internally provided with a hole 320 in communication with the coin outlet 311, a pusher 322 disposed on the surface of the turntable 321, at least one dialing device 33 disposed inside the storage space 310 and located around the drive module 32, and a spring plate 34 mounted in each through hole 312 of the casing 31. The dialing device 33 comprises a shaft 331 positioned on the bottom surface of the storage space 310, an elastomer 3311 mounted on the shaft 331, a paddle 332 pivotally disposed on the shaft 331 so as to be pressed against the elastomer 3311 and reciprocally rotated, a driving member 333 located on one end of the paddle 332 and drivable by the drive module 32 to cause the paddle 332 to rotate axially and provided with a dial block 3331 which can be pushed by the pusher 322 to cause the paddle 332 to rotate axially, and a dialing rod 334 upwardly extended from an opposite end of the paddle 332. The spring plate 34 comprises a positioning portion 341 positioned on the peripheral wall of the associating through hole 312, two spring arms 342 extended from one side of the positioning portion 341 toward the inside of the associating through hole 312, a gap 3420 formed between the two spring arms 342 for the insertion of the dialing rod 334, a channel 3421 formed on one side of the gap 3420 for the dialing rod 334 to pass, and a coin-stopping column 343 upwardly extended from the top surface of the distal end of each spring arm 342.

The height of the dialing rod 334 exposed above the two spring arms 342 of the spring plate 34 is less than the thickness of one metal coin 4, and the vertical distance between the surface of the stopper plate 313 and the paddle 332 is larger than the thickness of one metal coin 4 but less than the combined thickness of two metal coins 4.

Furthermore, the turntable 321 of the above drive module 32 is connected with a motor (not shown) so that the turntable 321 can be driven by the motor to generate axial rotation.

When the coin dispenser is assembled, the coin collecting tubes 2 are mounted in the accommodation chamber 10 of the body 1 below the coin hopper 12 for allowing the ducts 20 of the coin collecting tubes 2 to receive from metal coins 4 from the coin hopper 12, and then the coin dispensing unit 3 is mounted in the bottom side inside the accommodation chamber 10 of the body 1 to keep the through holes 312 of the casing 31 in alignment with the ducts 20 of the respective coin collecting tube 2 for receiving metal coins 4 from the ducts 20 of the respective coin collecting tube 2. Thus, the body 1, the coin collecting tubes 2 and the coin dispensing unit 3 are assembled to constitute the coin dispenser.

Figure 5:
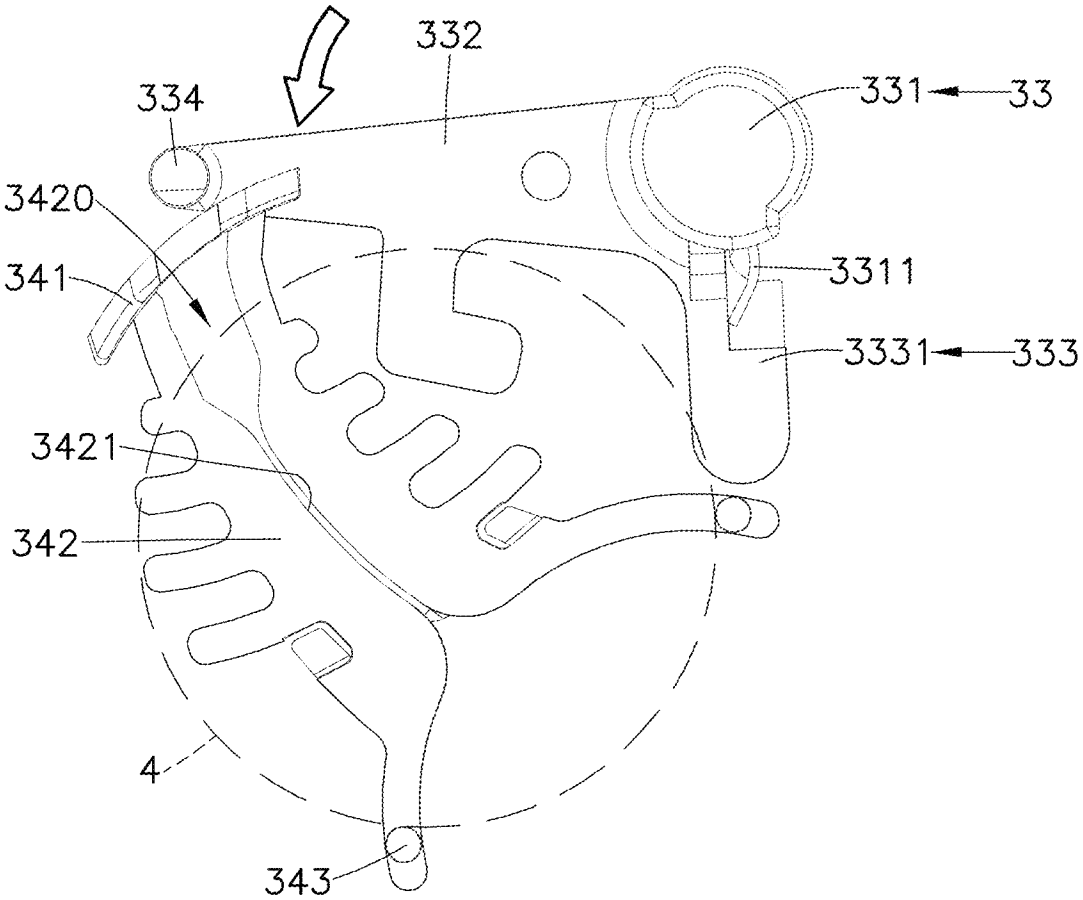
FIG. 5 is a schematic applied view of the present invention, showing the status of the coin dispensing unit before pushing a metal coin.
Figure 6:
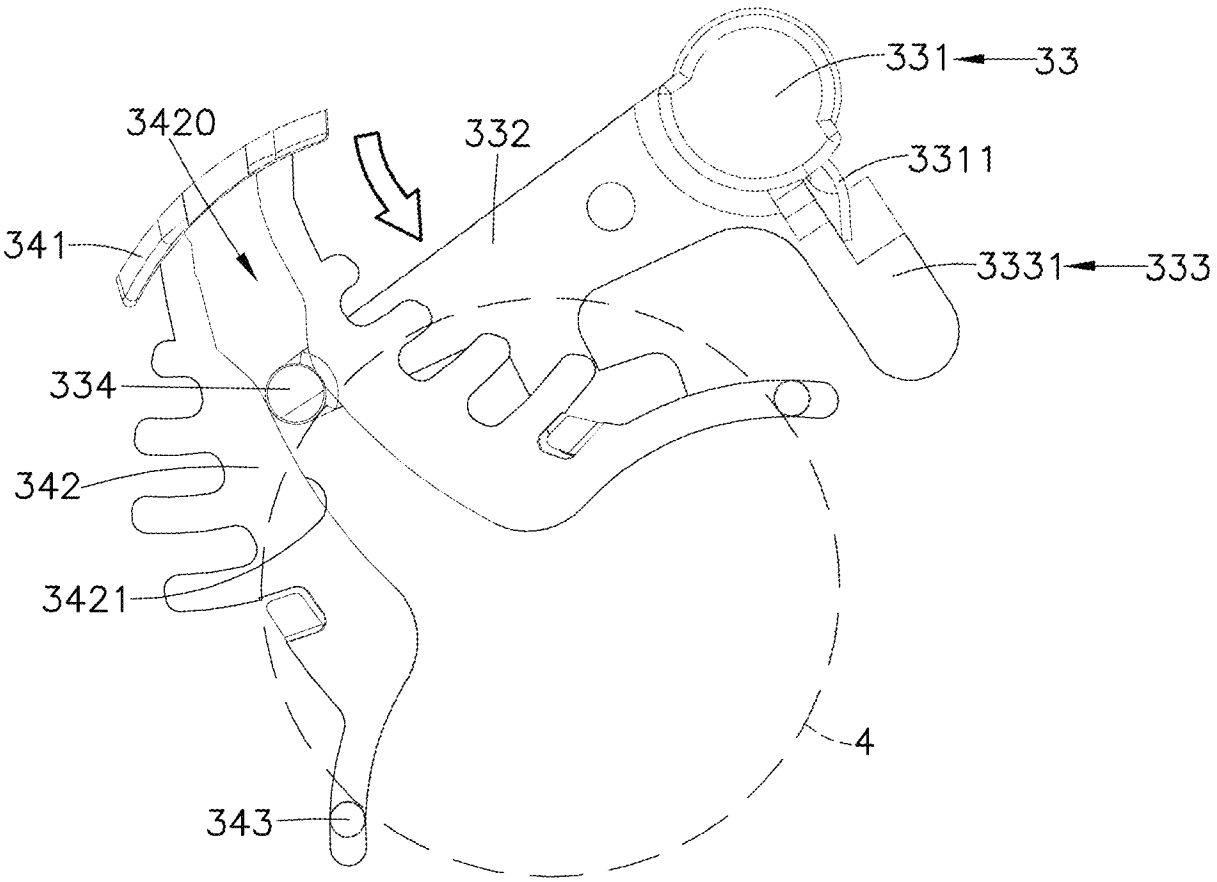
FIG. 6 is a schematic applied view of the present invention, showing the status of the coin dispensing unit when pushing a metal coin.
Figure 7:
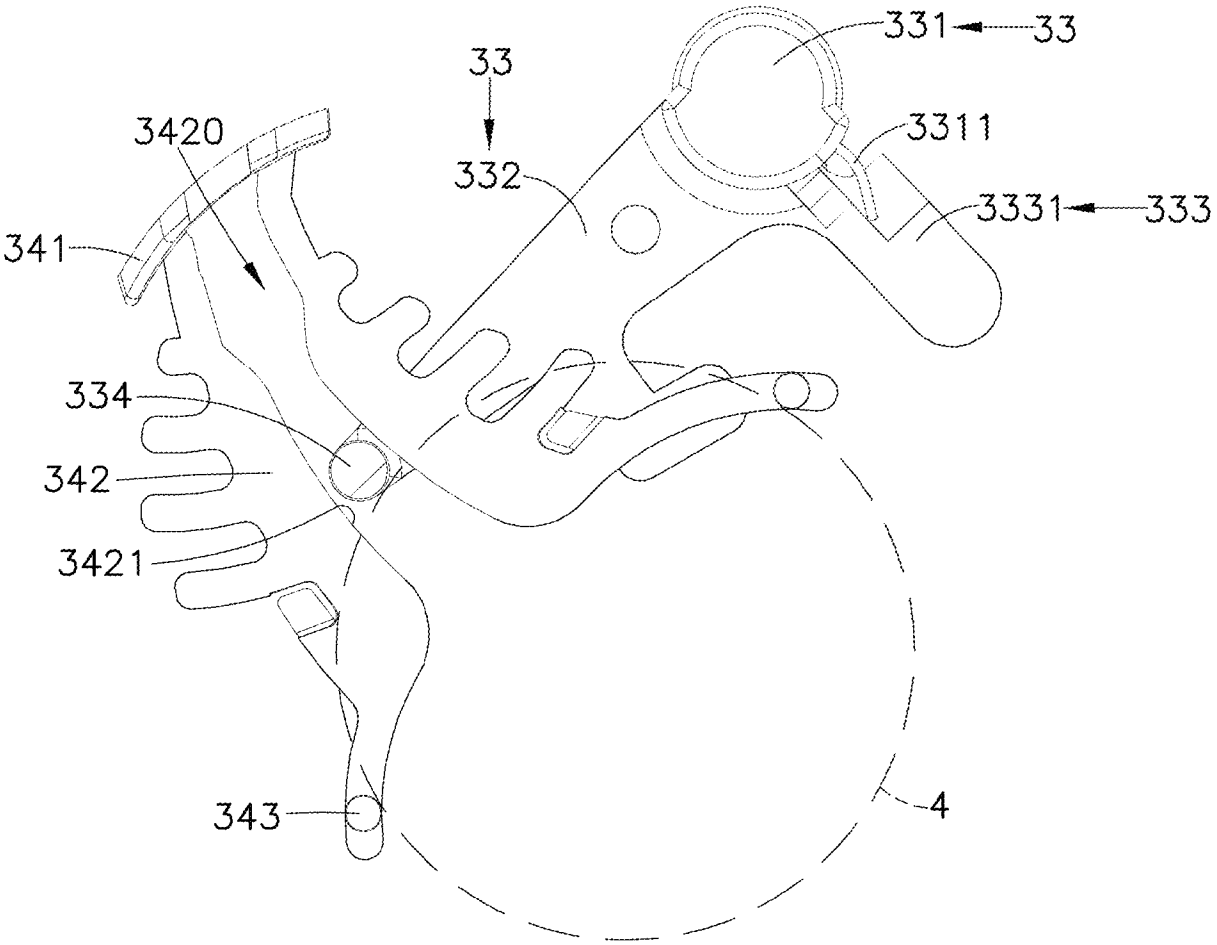
FIG. 7 is a schematic applied view of the present invention, showing the status of the coin dispensing unit after pushed the metal coin.

Referring to FIGS. 5-7, in actual application, metal coin(s) 4 can be inserted into the coin-inlet 120 of the coin hopper 12 of the body 1. When a metal coin 4 is inserted into the coin-inlet 120, it passes through the identification module 121 and coin sorting module 122 of the coin hopper 12 into the duct 20 of one respective coin collecting tube 2 and then falls through one respective through hole 312 of the casing 31 to the top side of the two spring arms 342 of one respective spring plate 34 inside of the coin dispensing unit 3 with the peripheral edge of the fallen metal coin 4 limited to the positioning portion 341 of the respective spring plate 34 and two coin-stopping column 343. At this time, turntable 321 of the drive module 32 is rotated axially, causing the pusher 322 at the turntable 321 to push the dial block 3331 of the driving member 333 of the dialing device 33, and thus, the paddle 332 of dialing device 33 uses shaft 331 as the axis to generate axial rotation. In this way, the dialing rod 334 on the paddle 332 is moved to enter the channel 3421 from the gap 3420 between the two spring arms 342 to push against one side of the peripheral edge of the metal coin 4, causing the other side of the peripheral edge of the metal coin 4 to push the two coin-stopping columns 343 to slide along the peripheral edge of the metal coin 4. This will make the two spring arms 342 relatively open. After the diameter of the metal coin 4 crosses two coin-stopping columns 343 from the two sides, the two spring arms 342 will elastically reset, so that the two coin-stopping columns 343 continue to slide along the peripheral edge of the metal coin 4. After the metal coin 4 completely passes between the two coin-stopping columns 343, the metal coin 4 will enter the hole 320 in the turntable 321, and then be sent from the coin outlet 311 of the casing 31 to the outside to complete the change or exchange function. After the metal coin 4 is dropped to the outside, the pusher 322 will not push against the dial block 3331 of driving member 333. At this time, the elastomer 3311 on the shaft 331 will elastically reset to return the dialing rod 334 to the original position within the gap 3420, thereby completing the use of the present invention to dispense one metal coin 4.

When plural metal coins 4 are dropped on the top side of the two spring arms 342 of one spring plate 34, due to that the height of the dialing rod 334 exposed above the two spring arms 342 of the spring plate 34 is less than the thickness of one metal coin 4, only one first metal coin 4 will be pushed outward as the dialing rod 334 pushing the peripheral edge of the metal coin 4, and the second metal coin 4 will not be pushed outward. Because the stopper plate 313 is provided inside the through hole 312, and the vertical distance between the surface of the stopper plate 313 and the paddle 332 is larger than the thickness of one metal coin 4 and less than the combined thickness of two metal coins 4, only one metal coin 4 will be pushed outward as the dialing rod 334 pushing the peripheral edge of the coin 4, and the second metal coin 4 will be stopped by stopper plate 313. In this way, the aforementioned size design can be used to further ensure that the second metal coin 4 will not be launched to the outside, so as to improve the reliability and stability of coin dispensing.

Furthermore, the coin-stopping columns 343 of the dialing device 33 are sliding along the peripheral edge of the metal coin 4, so as to have the effect of limiting the position of the metal coin 4, enabling the metal coin 4 to be accurately pushed out. Because the two coin-stopping columns 343 slide along the peripheral edge of the metal coin 4 through the two spring arms 342, this design can be used with multiple metal coins 4 of different sizes, so there is no need to design multiple coin dispensers to match metal coins 4 of different sizes, thereby achieving the effect of improving the use stability and reducing the manufacturing cost.

It is to be understood that the above-described embodiment of the invention is merely a possible example of implementations, merely set forth for a clear understanding of the principles of the invention, many modifications and enhancements may be made without departing from the spirit and scope of the invention. Accordingly, the invention is not to be limited except as by the appended claims.

What the invention claimed is:

1. A coin dispenser, comprising:

a body comprising a housing, said housing defining therein an accommodation chamber;

at least one coin collecting tube mounted in said housing, each said coin collecting tube defining therein a duct for receiving at least one metal coin; and a coin dispensing unit comprising a casing mounted in a bottom side of said accommodation chamber inside said body below said at least one coin collecting tube, a storage space defined in said casing, at least one through hole cut through a top wall of said casing and aimed at a bottom end of the said duct of one respective said coin collecting tube, a coin outlet located on an opposing bottom wall of said casing, a drive module mounted in said storage space inside the casing, at least one dialing device disposed inside said storage space and located around said drive module and a spring plate mounted in each said through hole of said casing, said dialing device comprising a shaft positioned on a bottom surface of said storage space, a paddle pivotally disposed on said shaft, a driving member located on one end of said paddle and drivable by said drive module to cause said paddle to rotate axially and a dialing rod upwardly extended from an opposite end of said paddle, said spring plate comprising a positioning portion positioned on the peripheral wall of the associating said through hole, two spring arms extended from one side of said positioning portion toward the inside of the associating said through hole, a gap formed between said two spring arms for the insertion of said dialing rod, a channel formed on one side of said gap for said dialing rod to pass and a coin-stopping column upwardly extended from a top surface of a distal end of each said spring arm;

wherein when said dialing rod is pushed against one side of the peripheral edge of said metal coin, the other side of the peripheral edge of said metal coin pushes against said coin- stopping columns to slide along the peripheral edge of said metal coin so that when said metal coin crosses two said coin-stopping columns, said metal coin is sent out of said coin outlet of said casing, and wherein said coin dispensing unit further comprises an elastomer mounted on said shaft said paddle is pressed against said elastomer and reciprocally rotated.

2. The coin dispenser as claimed in claim 1, wherein said body further comprises a coin hopper disposed in said accommodation chamber above said at least one coin collecting tube for dispensing said metal coins into said at least one coin collecting tube, said coin hopper having a coin-inlet defined at a top side thereof for the insertion of said metal coins.

3. The coin dispenser as claimed in claim 2, wherein said body further comprises an identification module mounted in said coin hopper below said coin-inlet for identifying the authenticity and value of each inserted metal coin, and a coin sorting module mounted in said coin hopper below said coin-inlet for sorting metal coins identified by said identification module into said at least one coin collecting tube.

4. The coin dispenser as claimed in claim 1, wherein said coin dispensing unit further comprises a slot cut through said top wall of said casing and radially extended from each said through hole, and a stopper plate mounted in each said slot and extended into the inside of the associating said through hole for stopping against the peripheral edge of the second said metal coin.

5. The coin dispenser as claimed in claim 4, wherein the vertical distance between said stopper plate and a paddle is larger than the thickness of one said metal coin but less than the combined thickness of two said metal coins.

6. The coin dispenser as claimed in claim 1, wherein said drive module of said coin dispensing unit comprises a turntable for axial rotation, and a pusher disposed on a top surface of said turntable; said driving member is provided with a dial block being able pushed by said pusher to cause said paddle to rotate axially.

7. The coin dispenser as claimed in claim 6, wherein said turntable is internally provided with a hole in communication with said coin outlet.

8. The coin dispenser as claimed in claim 1, wherein the height of said dialing rod exposed above said two spring arms of one said spring plate is less than the thickness of one said metal coin.

* * * * *